US007797964B1

(12) United States Patent
Lynch

(10) Patent No.: US 7,797,964 B1
(45) Date of Patent: Sep. 21, 2010

(54) RING CLASP AND SIZER

(76) Inventor: Karin Elizabeth Lynch, 5945 Dorothy Bolton Ct., Alexandria, VA (US) 22310

( * ) Notice: Subject to any disclaimer, the term of this patent is extended or adjusted under 35 U.S.C. 154(b) by 597 days.

(21) Appl. No.: 11/805,400

(22) Filed: May 24, 2007

(51) Int. Cl.
*A44C 9/00* (2006.01)

(52) U.S. Cl. ..... 63/15.2; 24/DIG. 33; 24/574.1; 63/15.6

(58) Field of Classification Search ..... None
See application file for complete search history.

(56) References Cited

U.S. PATENT DOCUMENTS

| | | | | |
|---|---|---|---|---|
| D178,743 | S * | 9/1956 | Walley | D11/87 |
| 3,483,717 | A * | 12/1969 | Mayer | 63/15.6 |
| 3,603,109 | A | 9/1971 | Virtanen | |
| 3,745,788 | A | 7/1973 | Sullivan | |
| 4,480,447 | A | 11/1984 | Lodrini | |
| 4,916,924 | A | 4/1990 | Borgenicht | |
| 5,231,853 | A | 8/1993 | Nicholson | |
| 5,239,842 | A | 8/1993 | Gesensway | |
| 5,253,491 | A | 10/1993 | Buontempo et al. | |
| 5,261,256 | A | 11/1993 | Ellenbecker et al. | |
| 5,417,085 | A | 5/1995 | Regev | |
| 5,636,531 | A | 6/1997 | Miller | |
| 5,669,241 | A | 9/1997 | Kohl | |
| 5,943,882 | A | 8/1999 | Erb | |
| 6,003,334 | A | 12/1999 | Miller | |
| 6,354,106 | B1 | 3/2002 | Kataw | |
| 6,484,536 | B1 | 11/2002 | Gould | |
| 6,526,779 | B2 | 3/2003 | Foote | |
| 6,672,105 | B1 | 1/2004 | Sills | |
| 6,748,764 | B1 | 6/2004 | Roemer | |

* cited by examiner

*Primary Examiner*—Jack W. Lavinder
(74) *Attorney, Agent, or Firm*—Joseph H. McGlynn

(57) ABSTRACT

A kit having a ring sizer and ring joiner. The kit has a plurality of circular bands that fit into and engage with a plurality of adjacent rings, such as a wedding ring and an engagement ring, to secure the plurality rings together. In addition, the bands are made in different thickness so the bands can also be used to adjust the size of the rings.

7 Claims, 1 Drawing Sheet

RING CLASP AND SIZER

BACKGROUND OF THE INVENTION

This invention relates, in general, to jewelry accessories, and, in particular, to a ring sizer and ring joiner for securing two adjacent rings.

DESCRIPTION OF THE PRIOR ART

In the prior art various types of jewelry accessories have been proposed. For example, U.S. Pat. No. 3,603,109 to Virtanen discloses a ring with a resilient ring guard and securing screw.

U.S. Pat. No. 3,745,788 to Sullivan discloses a finger ring and radially compressible adjustable sizing device, and a method of fitting a ring.

U.S. Pat. No. 4,480,447 to Lodrini discloses a finger ring and insert for the ring.

U.S. Pat. No. 4,916,924 to Borgenicht discloses a finger ring reducing means.

U.S. Pat. No. 5,231,853 to Nicholson discloses a nesting bezel structure for stacked rings.

U.S. Pat. No. 5,239,842 to Gesenway discloses a spring ring adjuster.

U.S. Pat. No. 5,253,491 to Buontempo et al discloses a finger ring and size adjustment insert.

U.S. Pat. No. 5,261,256 to Ellenbecker et al discloses an instant flex ring guard.

U.S. Pat. No. 5,417,085 to Regev discloses a ring having interchangeable finger sized portions.

U.S. Pat. No. 5,636,531 to Miller discloses a finger ring adjustment device.

U.S. Pat. No. 5,669,241 to Kohl discloses a hinged finger ring.

U.S. Pat. No. 5,943,882 to Erb discloses a self-sizing ring.

U.S. Pat. No. 6,003,334 to Miller discloses a finger ring size adjusting device and method.

U.S. Pat. No. 6,354,106 to Kataw discloses a finger ring fitting aid.

U.S. Pat. No. 6,484,536 to Gould discloses interlocking rings.

U.S. Pat. No. 6,526,779 to Foote discloses a widow and widower ring and identification system which attaches two rings to each other.

U.S. Pat. No. 6,672,105 to Sills discloses a finger ring fit adjuster.

U.S. Pat. No. 6,748,764 to Roemer discloses a self-adjusting ring size reducer.

International Patent Application No. WO 99/63854 published on Dec. 16, 1999 to Curwood discloses a joiner for jewelry.

SUMMARY OF THE INVENTION

The present invention is directed to a kit having a ring sizer and ring joiner. The kit has a plurality of circular bands that fit into and engage with plurality of adjacent rings such as a wedding ring and an engagement ring to secure the plurality of rings together. In addition, the bands are made in different thickness so the bands can also be used to adjust the size of the rings.

It is an object of the present invention to provide a new and improved jewelry accessory that will allow a user to secure the adjacent rings from turning with respect to each other when on a user's finger.

It is an object of the present invention to provide a new and improved jewelry accessory that can adjust the size of the rings.

The anatomy of a ring finger makes wearing two or more stacked or side-by-side rings, such as a wedding ring and an engagement ring, problematical. The rings must pass over a knuckle which is basically an incompressible part of the finger, and then, to fit around the area of the finger just past the knuckle, which is compressible. In some cases, the knuckle is larger than the area past the knuckle. In order to allow a ring to pass the knuckle it must be larger than the area of the finger just past the knuckle. This allows the rings to rotate with respect to each other and also to rotate around a user's finger during normal wear.

In the case of a wedding ring and an engagement ring, the turning of the rings with respect to each other is annoying since the stone of the ring does not remain centered on the finger. Also, this turning of the ring with the stone can cause the stone to rub against the side of the finger causing pain to the wearer.

Another problem is a person may gain or loose weight during their life and rings which at one time fit no longer do so. A loose fitting ring is not only annoying but also may result in accidental loss by slipping over the wearer's knuckle during rapid hand movement, or when the skin of the hand is cold, wet, or lubricated with materials such as oil, soap or hand cream.

While the prior art has recognized some of these problems none of the prior patents have addressed and solved both of these problems. The present invention is designed to overcome the shortcomings of the prior art.

It is an object of the present invention to provide a new and improved jewelry accessory that can be used with any size rings.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
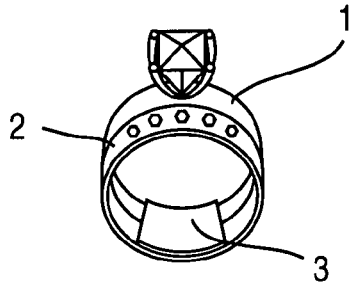
FIG. 1 is a perspective view of the present invention secured to a plurality of adjacent rings.

Referring now to the drawings in greater detail, FIG. 1 shows one of the accessories of the present invention in place within a pair of rings 1 and 2 which are directly adjacent each other or stacked. The rings shown are merely for illustrational purposes and different sizes or number or types of rings may be used with the present invention without departing from the scope of the present invention. The rings, for example, can be a wedding ring and an engagement ring that are normally worn by a woman on the same finger in a side-by-side or stacked manner. The problem with wearing two rings in this manner is that they will often rotate with respect to each other. This rotation will cause one of the rings to be out of alignment with the other ring which can be non-esthetic. Also, this turning of the ring having the stone can cause the stone to rub against the side of the finger causing pain to the wearer.

Figure 2:
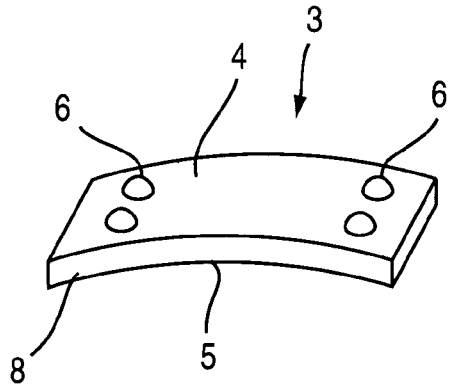
FIG. 2 is a perspective of the bottom of the present invention.

In order to alleviate the problems associated with the prior art, the present invention provides a kit which contains a plurality of inserts (see for example FIGS. 4 and 5) which can be inserted onto the inside of the band of the rings. One of the inserts 3 is shown in FIG. 2. The insert 3 is basically a partially curved plate having a top surface 5, a bottom surface 4 and sides 8 extending between the top and bottom surfaces. When referring to the top and bottom surfaces, the top surface 5 is considered to be the surface closest to the wearer's finger when the insert is inserted into the rings and the rings are on a user's finger. The bottom surface 4 is considered to be the surface furthest from the wearer's finger when the insert is inserted into the rings and the rings are on a user's finger. To put it another way, the bottom surface 4 of the insert 3 is directly adjacent the inside of the rings, as seen in FIG. 1, and the top surface 5 is directly adjacent the wearer's finger.

Figure 3:
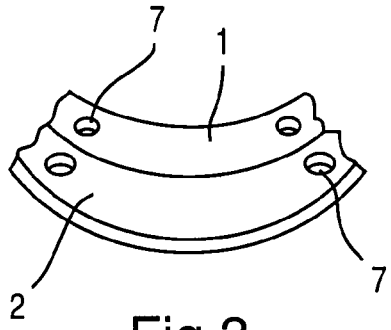
FIG. 3 is a partial perspective view of a plurality rings used with the present invention.

As Seen in FIG. 2, the insert 3 has a plurality of projections 6 spaced on the bottom surface 4. Also, the width of the insert 3 will be wide enough so some of the width is engaging one of the rings and some of the width is engaging another of the rings. Some of the projections 6 will be positioned on the insert 3 so they will engage the apertures or divots 7 in the band of ring 1 and some of the projections 6 will be positioned on the insert 3 so they will engage the apertures 7 in the band of ring 2 (see FIG. 3 for the apertures). This engagement between the projections 6 on the insert 3 and the bands of the rings will lock the two rings together and prevent rotation of the rings with respect to each other.

Figure 4:
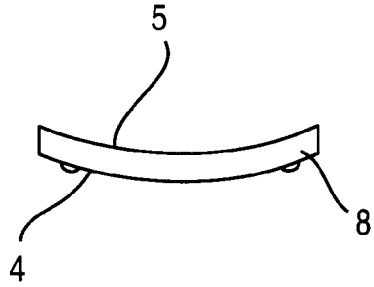
FIG. 4 is a side view of one of the jewelry accessories of the present invention having a first thickness.
Figure 5:
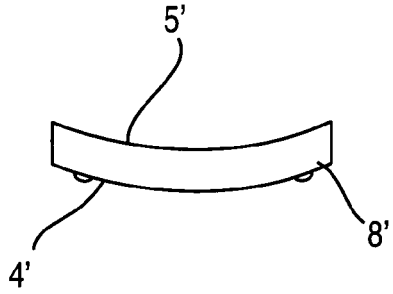
FIG. 5 is a side view of another of the jewelry accessories of the present invention having a different thickness.

FIGS. 4 and 5 show two of the inserts that can be used with the kit of the present invention. The insert of FIG. 4 has a top surface 5 which is further away from the bottom surface 4 to provide a selected thickness to the insert. The insert of FIG. 5 has a top surface 5' which is further away from the bottom surface 4' to provide a second selected thickness to the insert which is larger than the thickness of the insert in FIG. 4. In this manner by selecting the right thickness of insert from the kit a user can adjust the size of the rings to fit their finger properly.

It should be noted that the two inserts shown are not the only inserts that can be supplied with the kit. The kit could include just one insert, if the only problem the user is concerned with is locking the rings together, or the kit could include a plurality of inserts if the user is also concerned with adjusting the size of the rings to fit their finger. Some users may anticipate gaining or losing weight and would like to have a number of inserts on hand so the insert with the proper thickness can be chosen to provide a proper fit of the rings on the user's finger.

Although the Ring Clasp and Sizer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A kit for use with a plurality of rings worn on the same finger of a wearer's finger in combination with a plurality of rings, wherein said kit comprises:

at least one insert, said at least one insert having a top surface and a bottom surface, and said at least one insert having sides extending between said top and bottom surface, said at least one insert having means on said bottom surface for engaging a plurality of rings, and said plurality of rings having means for cooperating with said means on said bottom surface for locking said plurality of rings together, and wherein said means for cooperating with said means on said bottom surface for locking said pair of rings together comprises a plurality of apertures.

2. The kit for use with a plurality of rings as claimed in claim 1, wherein said means on said bottom surface of said at least one insert is a plurality of projections.

3. The kit for use with a plurality of rings as claimed in claim 1, wherein said projections extend away from said bottom surface of said insert.

4. The kit for use with a plurality of rings as claimed in claim 1, wherein said at least one insert is curved.

5. The kit for use with a plurality of rings as claimed in claim 1, wherein said kit contains a plurality of inserts.

6. The kit for use with a plurality of rings as claimed in claim 1, wherein each of said plurality of inserts has a different thickness.

7. The kit for use with a plurality of rings as claimed in claim 1, wherein one of said plurality of rings has a width and another of said plurality rings has another width, said at least one insert has a width which is approximately equal to said width of one of said a plurality of rings plus said width of said another of said plurality rings.

* * * * *